US009806471B2

(12) United States Patent
Orris et al.

(10) Patent No.: US 9,806,471 B2
(45) Date of Patent: Oct. 31, 2017

(54) POWER CONNECTOR AND A PLUGGABLE CONNECTOR CONFIGURED TO MATE WITH THE POWER CONNECTOR

(71) Applicants: Tyco Electronics Corporation, Berwyn, PA (US); TE Connectivity Nederland BV, Ar's-Hertogenbosch (NL); Tyco Electronics Svenska AB, Upplands Vasby (SE)

(72) Inventors: David Orris, Middletown, PA (US); Sebastiaan Neerincx, Tilburg (NL); Hacan Hyving, Bollnas (SE); Rickard Barrefelt, Stockholm (SE)

(73) Assignees: TE CONNECTIVITY CORPORATION, Berwyn, PA (US); TE CONNECTIVITY NEDERLAND B.V., Ar's-Hertogenbosch (NL); TYCO ELECTRONICS SVENSKA AB, Upplands Vasby (SE)

( * ) Notice: Subject to any disclaimer, the term of this patent is extended or adjusted under 35 U.S.C. 154(b) by 201 days.

(21) Appl. No.: 14/741,787

(22) Filed: Jun. 17, 2015

(65) Prior Publication Data

US 2016/0372872 A1 Dec. 22, 2016

(51) Int. Cl.

| | |
|---|---|
| ***H01R 13/707*** | (2006.01) |
| ***H01R 11/01*** | (2006.01) |
| ***H01R 27/02*** | (2006.01) |

(52) U.S. Cl.

CPC ..... *H01R 13/707* (2013.01); *H01R 11/01* (2013.01); *H01R 27/02* (2013.01)

(58) Field of Classification Search

CPC ..... H01R 13/707; H01R 11/01; H01R 27/02; H01R 13/6658; H01R 2103/00;

(Continued)

(56) References Cited

U.S. PATENT DOCUMENTS 6,019,616 A * 2/2000 Yagi ..... H01R 13/65802 439/108
7,241,157 B2 * 7/2007 Zhuang ..... H01R 13/7035 439/188

(Continued)

OTHER PUBLICATIONS

Tyco Electronics Corporation; Power Connectors & Interconnection Systems; Catalog 1773096; www.tycoelectronics.com; Tyco Electronics Corporation.

(Continued)

*Primary Examiner* — Edwin A. Leon

(57) ABSTRACT

Power connector includes a connector housing having a mating side and a mounting side. The connector housing includes a receiving cavity that opens to the mating side. The mounting side is configured to interface with an electrical component. The power connector also includes first and second power contacts disposed within the receiving cavity and configured to be terminated to the electrical component. The power connector also includes a multi-function contact configured to be terminated to the electrical component. The multi-function contact includes a switch segment that is disposed within the receiving cavity. The switch segment has a mating interface that is configured to engage the first power contact and is capable of flexing between first and second positions. The mating interface engages the first power contact in the first position and is separated from the first power contact in the second position.

20 Claims, 6 Drawing Sheets

(58) Field of Classification Search
CPC ..... H01R 13/6275; H01R 13/65082; H01R 13/6873; H01R 23/025; H01R 23/7073
USPC ..... 439/620.21, 188, 660, 676, 680, 108
See application file for complete search history.

(56) References Cited

U.S. PATENT DOCUMENTS

| | | | | |
|---|---|---|---|---|
| 7,402,057 | B1 * | 7/2008 | Strang | H01R 13/7032 439/188 |
| 8,905,779 | B2 * | 12/2014 | Little | H01R 13/641 439/489 |
| 8,961,240 | B2 * | 2/2015 | Tai | H01R 13/6456 439/680 |
| 2007/0059973 | A1 * | 3/2007 | Fabian | H01R 13/112 439/475 |
| 2013/0196544 | A1 * | 8/2013 | Little | H01R 12/71 439/626 |

OTHER PUBLICATIONS

Tyco Electronics Nederland B.V.; Standard Timer Cable to Board Connector System; Dec. 9, 2011; Rev B; pp. 1-5; Tyco Electronics Corporation.
TE Connectivity Ltd. Company; Standard Power Timer Contact; Jan. 29, 2015; Rev J; pp. 1-15; TE Connectivity AMP Espana.
Tyco Electronics Corporation; Two Position Cable-to-Board Power Connector System (Right Angle/Straight) with Coding Contacts; Apr. 17, 2013; Rev F, pp. 1-8; Tyco Electronics Corporation.

* cited by examiner

POWER CONNECTOR AND A PLUGGABLE CONNECTOR CONFIGURED TO MATE WITH THE POWER CONNECTOR

BACKGROUND

The subject matter herein relates generally to power connectors and pluggable connectors that mate with the power connectors.

Complex electrical systems, such as those found in power distribution units, core networks, cellular base stations, servers, storage systems, network power systems, and automotive systems, have a number of components that are interconnected with each other. Due to the particular configurations and requirements of these components, a variety of different power connectors and cables exist for supplying electrical power to the interconnected components. For example, a known power connector (hereinafter referred to as a "board connector") is configured to be mounted to a circuit board and mate with another power connector (hereinafter referred to as a "pluggable connector"). The board connector has a connector housing that forms a receiving cavity. The board connector also includes a supply contact and a return contact that are terminated to the circuit board. The pluggable connector includes corresponding contacts that engage the supply and return contacts of the board connector. The electrical power supplied to the board connector is typically in the form of direct current (DC).

Although the board connector described above is effective in mating with the pluggable connector and supplying electrical power to the circuit board, the board connector is typically configured to mate with a single type of pluggable connector. For example, if another type of pluggable connector has a different number and/or arrangement of power contacts, the board connector may not be able to effectively mate with the pluggable connector. It may be desirable for a board connector to be matable with different types of pluggable connectors that have a different number and/or arrangement of power contacts.

Accordingly, a need exists for a power connector that is capable of mating with different types of pluggable connectors that have a different number and/or arrangement of power contacts.

BRIEF DESCRIPTION

In an embodiment, a power connector is provided that is configured to mate with different types of pluggable connectors. The power connector includes a connector housing having a mating side and a mounting side. The connector housing includes a receiving cavity that opens to the mating side. The mounting side is configured to interface with an electrical component. The power connector also includes first and second power contacts disposed within the receiving cavity and configured to be terminated to the electrical component. The power connector also includes a multi-function contact configured to be terminated to the electrical component. The multi-function contact includes a switch segment that is disposed within the receiving cavity. The switch segment has a mating interface that is configured to engage the first power contact and is capable of flexing between first and second positions. The mating interface engages the first power contact in the first position and is separated from the first power contact in the second position.

In some embodiments, the power connector is configured to mate with a two-wire pluggable connector when the switch segment is engaged with the first power contact and a three-wire pluggable connector when the switch segment is deflected away from the first power contact. Optionally, the switch segment is configured to be deflected from the first position to the second position. In other embodiments, the switch segment may be deflected from the second position to the first position.

In an embodiment, a pluggable connector is provided that includes a connector body having a main housing and a plug housing that projects from the main housing. The plug housing is configured to be inserted into a receiving cavity of a power connector during a mating operation. The plug housing has a mating end that leads the plug housing into the receiving cavity. The plug housing defines a housing cavity that opens to the mating end. The pluggable connector also includes first and second power contacts that are disposed within the housing cavity and configured to engage corresponding contacts of the power connector during the mating operation. The pluggable connector also includes an outer contact having a contact surface. At least a portion of the contact surface extends between the main housing and the mating end of the plug housing. The contact surface is exposed to an exterior of the plug housing and configured to engage a corresponding contact of the power connector during the mating operation.

In an embodiment, an interconnection system is provided that includes a power connector configured to be mounted to an electrical component. The power connector includes a connector housing having a mating side and a receiving cavity that opens to the mating side. The power connector includes first and second power contacts disposed within the receiving cavity, and a multi-function contact having a switch segment that is disposed within the receiving cavity. The switch segment capable of flexing between first and second positions. The interconnection system also includes a pluggable connector having a plug housing configured to be inserted into the receiving cavity of the power connector. The plug housing having a mating end that includes a switch activator. The plug housing defines a housing cavity that opens to the mating end. The pluggable connector includes first and second power contacts that are disposed within the housing cavity. The power connector and the pluggable connector are configured to mate with each other during a mating operation. The switch activator of the pluggable connector leads the plug housing into the receiving cavity during the mating operation and engages the switch segment of the multi-function contact of the power connector. The switch activator deflects the switch segment from the first position to the second position or from the second position to the first position. The first and second power contacts of the pluggable connector and the first and second power contacts of the power connector, respectively, are engaged after the mating operation.

In some embodiments, the multi-function contact includes a mating segment that is disposed within the receiving cavity of the power connector. The pluggable connector includes an outer contact having a contact surface that is exposed to an exterior of the plug housing, wherein the outer contact and the mating segment of the multi-function contact are engaged after the mating operation.

DETAILED DESCRIPTION

Embodiments set forth herein include power connectors that may be capable of mating with different types of pluggable connectors. In some embodiments, the power connectors include circuit assemblies that are capable of forming different electrical circuits based on the type of pluggable connector that is mated to the corresponding power connector. For example, a first type of pluggable connector may include a plurality of power contacts that are configured for three-wire applications. A second type of pluggable connector may include a plurality of power contacts that are configured for two-wire applications. When a power connector is mated with the first type of pluggable connector, the circuit assembly may have a first electrical configuration. However, when the power connector is mated with the second type of pluggable connector, the circuit assembly may have a different second electrical configuration. For example, the first and second electrical configurations may have different electrical pathways between the corresponding pluggable connector and the electrical component. In particular embodiments, at least one of the types of pluggable connectors may activate or trigger a switch that changes the electrical configuration of the circuit assembly.

Figure 1:
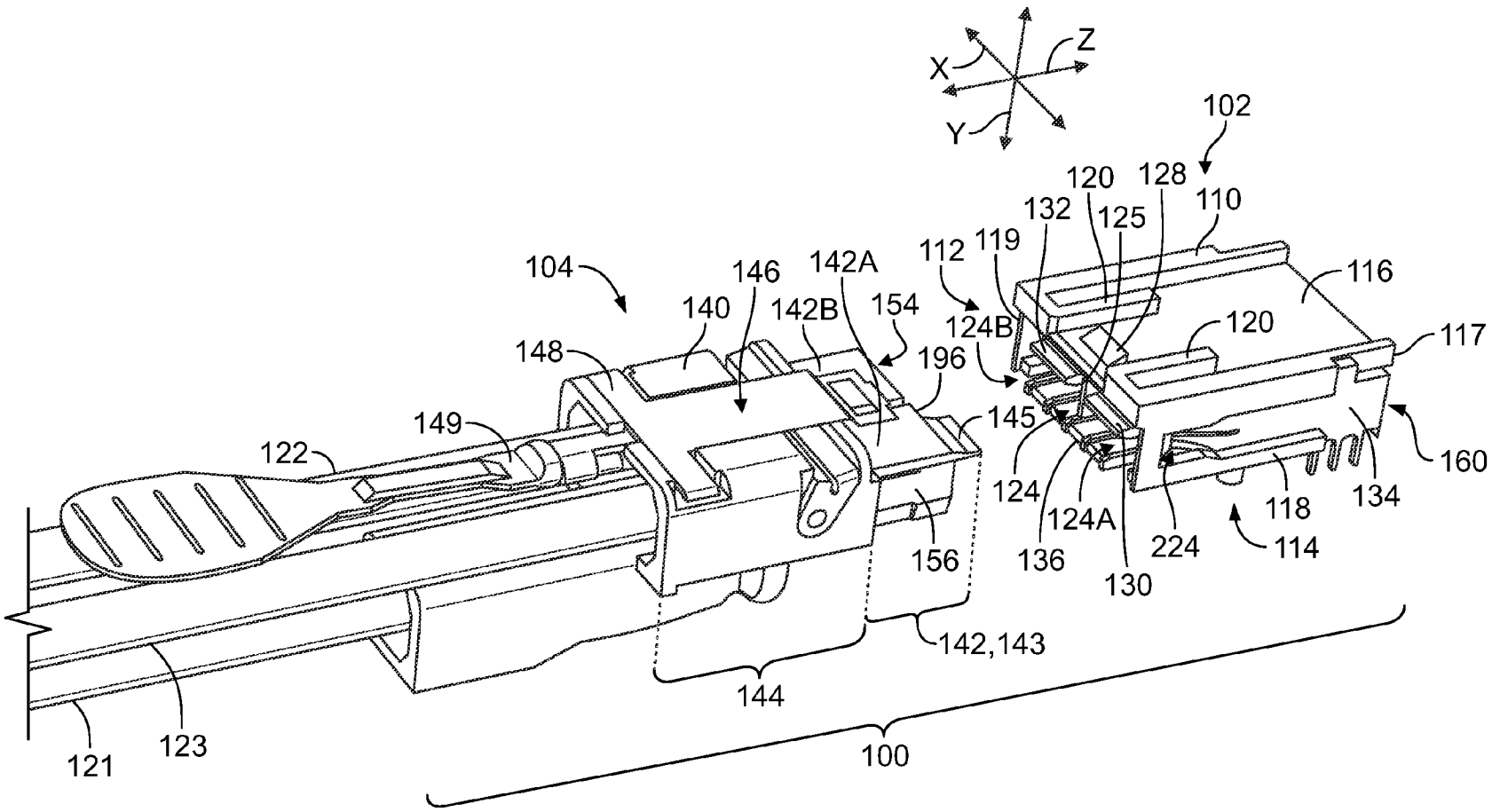
FIG. 1 is a perspective view of an interconnection system formed in accordance with an embodiment including a power connector and a pluggable connector.

FIG. 1 is a perspective view of an interconnection system 100 formed in accordance with an embodiment. The interconnection system 100 is oriented with respect to mutually perpendicular X, Y, and Z axes. The interconnection system 100 includes a power connector 102 and a power connector 104 that are configured to mate with each other during a mating operation. The power connector 104 is hereinafter referred to as a pluggable connector 104. It is noted that the pluggable connector 104 is a first type of pluggable connector. As described herein, the power connector 102 is also capable of mating with at least one other type of pluggable connector, such as the pluggable connector 300 (shown in FIG. 11).

Figure 4:
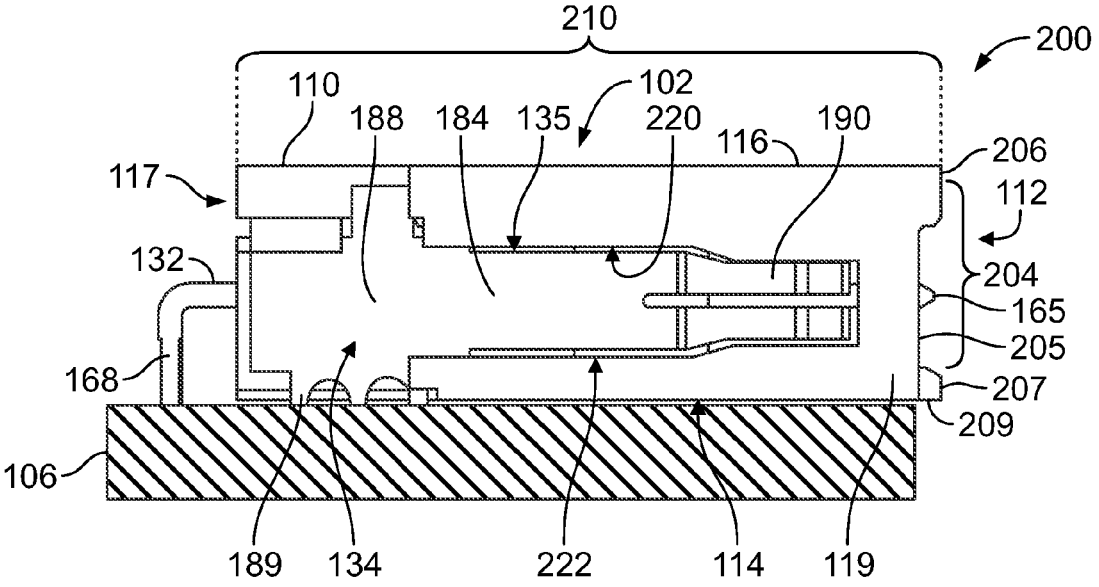
FIG. 4 is a side view of a circuit board assembly that includes the power connector of FIG. 1 and a circuit board.

In an exemplary embodiment, the power connector 102 is configured to be mounted to an electrical component 106 (shown in FIG. 4). The electrical component 106 may also be part of the interconnection system 100. In particular embodiments, the electrical component 106 is a circuit board. As such, the power connector 102 may also be referred to as a board connector. However, it should be understood that the power connector 102 may be used in other applications. As an example, the power connector 102 may be configured to interconnect two cable harnesses or two electrical devices. Moreover, although the electrical component 106 is a circuit board in the illustrated embodiment, it is contemplated that other types of electrical components may be used.

The power connector 102 includes a connector housing 110 having a mating side or face 112 and a mounting side or face 114. The connector housing 110 includes housing walls 116-119, which are referred to as a top wall 116, a back wall 117, a sidewall 118, and a sidewall 119. The top wall 116 includes a pair of guide tracks 120 and a lug 128 positioned between the guide tracks 120. Although spatially relative terms, such as "top" or "bottom," may be used, it should be understood that the power connector 102 and the pluggable connector 104 may have any orientation with respect to gravity.

In the illustrated embodiment, the mating side 112 faces in a direction that is generally along the Z axis, and the mounting side 114 faces in a direction that is generally along the Y axis. As such, the power connector 102 may be characterized as a right-angle connector. In other embodiments, however, the power connector 102 may be characterized as a vertical connector in which the mating and mounting sides face in opposite directions along a common axis, such as the Z-axis or Y-axis.

In the illustrated embodiment, the connector housing 110 defines a receiving cavity 124 that opens to the mating side 112. The receiving cavity 124 may be divided into separate cavity portions 124A, 124B by a partition wall 125 (also shown in FIG. 5). However, the receiving cavity 124 may be a single space in other embodiments. The receiving cavity 124 is configured to receive a plug housing 142 of the pluggable connector 104 during a mating operation.

The connector housing 110 is configured to at least partially surround a circuit assembly 160 that includes a number of conductive elements (or circuit elements) of the power connector 102. In the illustrated embodiment, the conductive elements include first and second power contacts 130, 132, a multi-function contact 134, and coding contacts 136. Each of the first and second power contacts 130, 132, the multi-function contact 134, and the coding contacts 136 may electrically couple to a corresponding contact of the pluggable connector 104. The coding contacts 136 may be used to determine information about the type of pluggable connector that is mated to the power connector 102.

Figure 11:
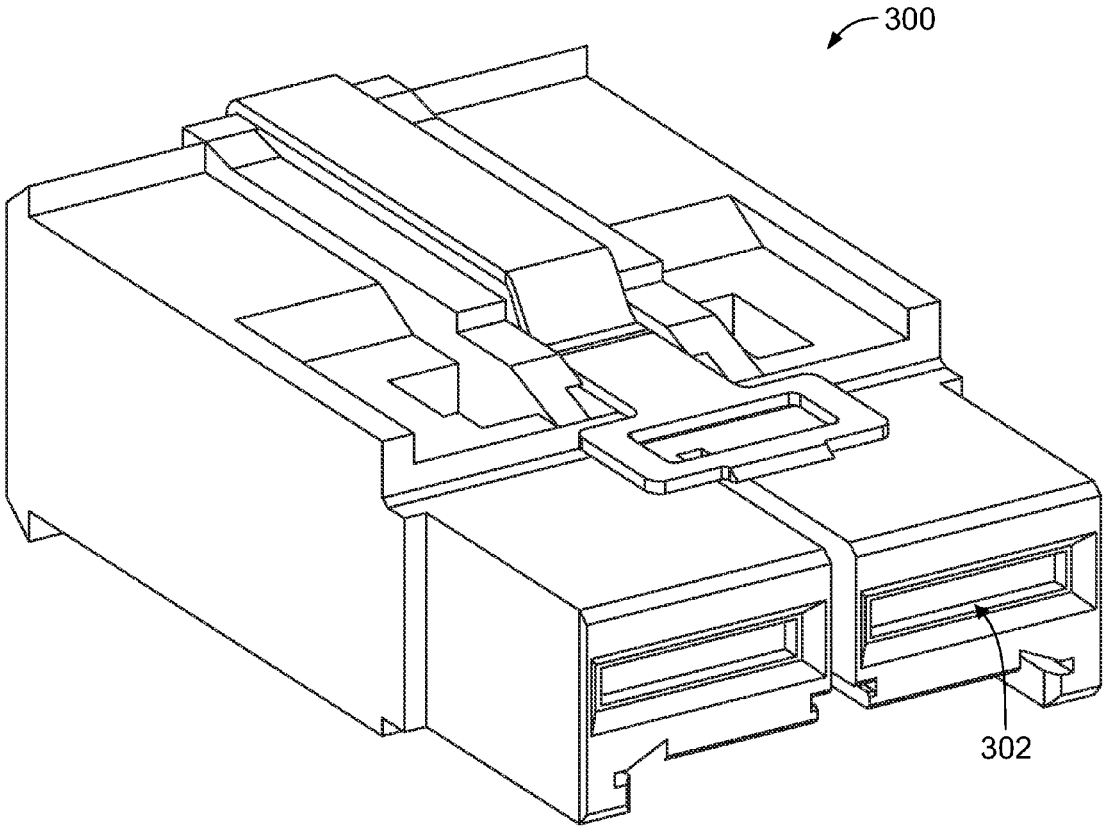
FIG. 11 illustrates a pluggable connector that is configured to mate with the power connector of FIG. 1.

An electrical configuration of the circuit assembly 160 is based on the type of pluggable connector that is mated with the power connector 102. For example, when the power connector 102 is mated with the pluggable connector 104, the first power contact 130, the second power contact 132, and the multi-function contact 134 may operate as separate electrical pathways for providing electrical power to the electrical component. Such embodiments may be used in alternating current (AC) applications. However, when the power connector 102 is mated with a second type of pluggable connector, such as the pluggable connector 300 (FIG. 11), the first power contact 130 may function as a return contact, the second power contact 132 may function as a supply contact that supplies electrical power to the electrical component, and the multi-function contact 134 may electrically couple the first power contact 130 to earth (or ground). In such embodiments, the interconnection system 100 may be configured for direct current (DC) applications. Accordingly, the power connector 102 may be capable of forming different electrical circuits based on the type of pluggable connector that is mated to the power connector 102. In an exemplary embodiment, the pluggable connector 104 is a 3-wire connector. The power connector 102 may also be configured to mate with a two-wire connector, such as the pluggable connector 300 (FIG. 11).

The pluggable connector 104 includes a connector body 140 having the plug housing 142 and a main housing 144 that is coupled to and supports the plug housing 142. The main housing 144 is coupled to and/or receives cables 121-123. The plug housing 142 projects away from the main housing 144 along the Z-axis. The plug housing 142 includes a mating end 154 that leads the plug housing 142 into the receiving cavity 124. The mating end 154 includes a front edge 196. The plug housing 142 is sized and shaped to be received within the receiving cavity 124. For example, the plug housing 142 may have a length 143 that is substantially equal to or less than a depth of the receiving cavity 124. In the illustrated embodiment, the plug housing 142 forms separate housing portions 142A, 142B that are configured to be inserted into the cavity portions 124A, 124B, respectively.

Optionally, the mating end 154 includes a switch activator 145 that extends from the front edge 196 of the plug housing 142 along the Z-axis. The switch activator 145 may lead the plug housing 142 into the receiving cavity 124 or, more specifically, the cavity portion 124A. In some embodiments, the plug housing 142 and the main housing 144 may be formed from a common mold such that the connector body 140 is a single unitary structure. In other embodiments, the plug housing 142 and the main housing 144 may constitute or include discrete components.

The pluggable connector 104 also has a coupling mechanism 146 that includes a latch element 148 and a pull tab 149. The latch element 148 is configured to slide between the guide tracks 120 of the power connector 102 and engage the lug 128 on the top wall 116. The latch element 148 may couple to the lug 128 and prevent the pluggable connector 104 from being inadvertently unmated from the power connector 102. The pull tab 149 may be used to release the pluggable connector 104 from the power connector 102 to permit the pluggable connector 104 to be removed.

Figure 6:
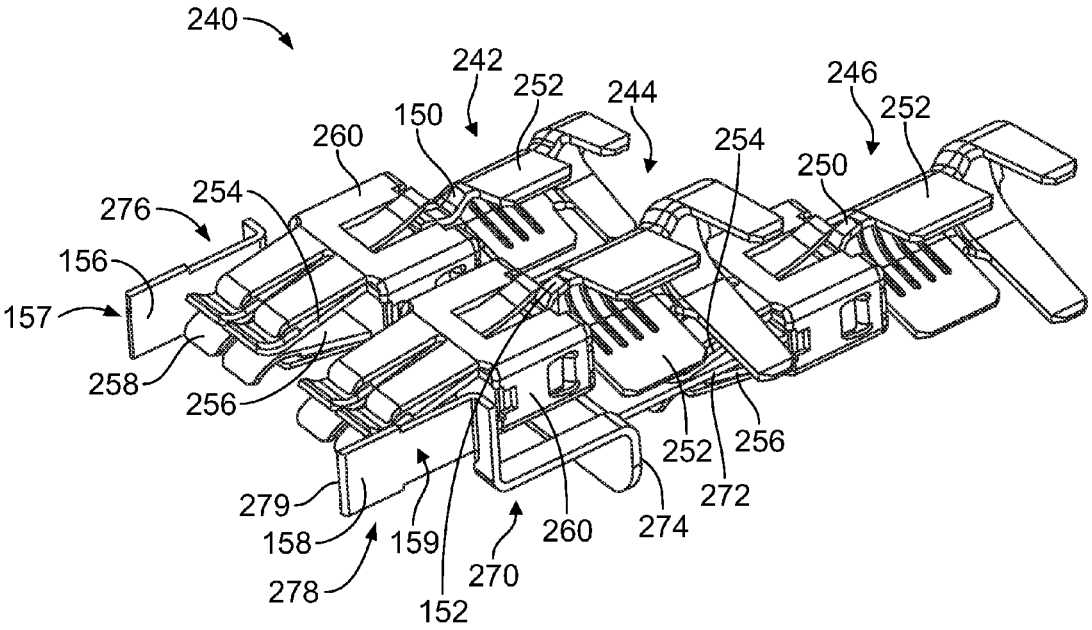
FIG. 6 is a perspective view of a circuit assembly of the pluggable connector of FIG. 1 in accordance with an embodiment.

The connector body 140 is configured to hold or support a plurality of conductive elements of the pluggable connector 104. For example, the pluggable connector 104 may include first and second power contacts 150, 152 (shown in FIG. 6), an outer contact 156, and an outer contact 158 (FIG. 6). In the illustrated embodiment, the outer contacts 156, 158 are electrically common. However, in other embodiments, the outer contacts 156, 158 may be electrically separate. The outer contacts 156, 158 extend between the mating end 154 and the main housing 144. In this context, the phrase "extends between" (and the like) includes the outer contacts 156 extending to the mating end 154 and projecting beyond the mating end 154 such that the outer contacts 156, 158 have a length that is greater than the length 143. The outer contacts 156, 158 are exposed at least partially along the length 143 of the plug housing 142. The outer contacts 156, 158 are configured to engage the multi-function contact 134 as described herein.

Figure 2:
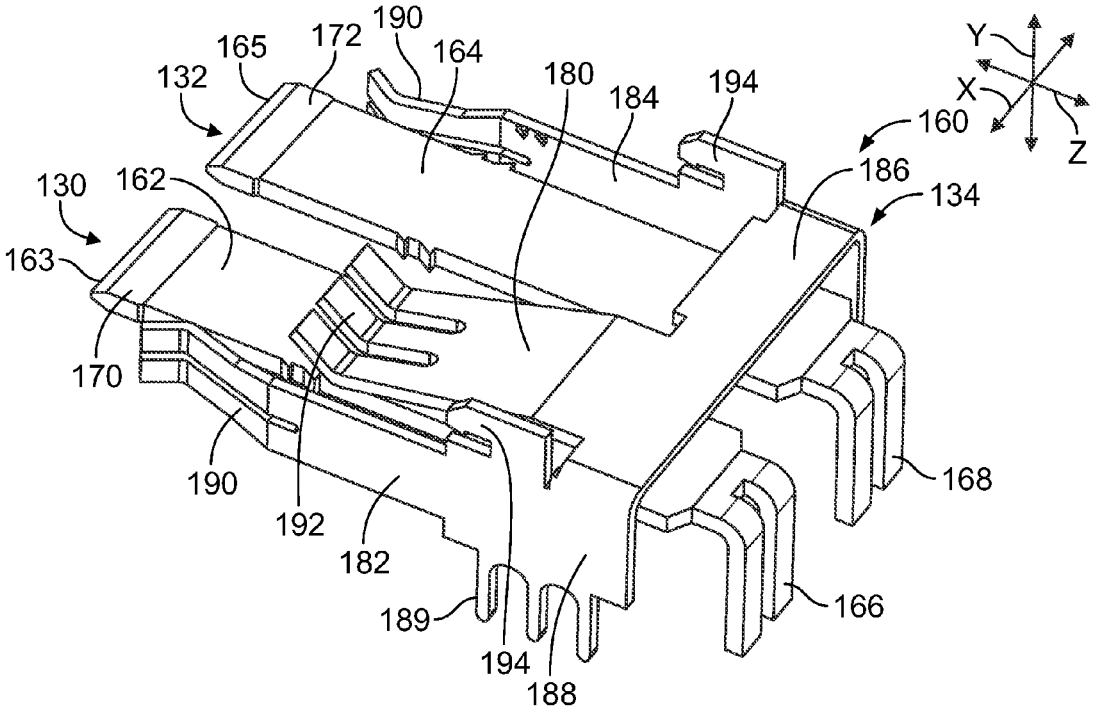
FIG. 2 is a side perspective view of a circuit assembly that may be used with the power connector of FIG. 1.
Figure 3:
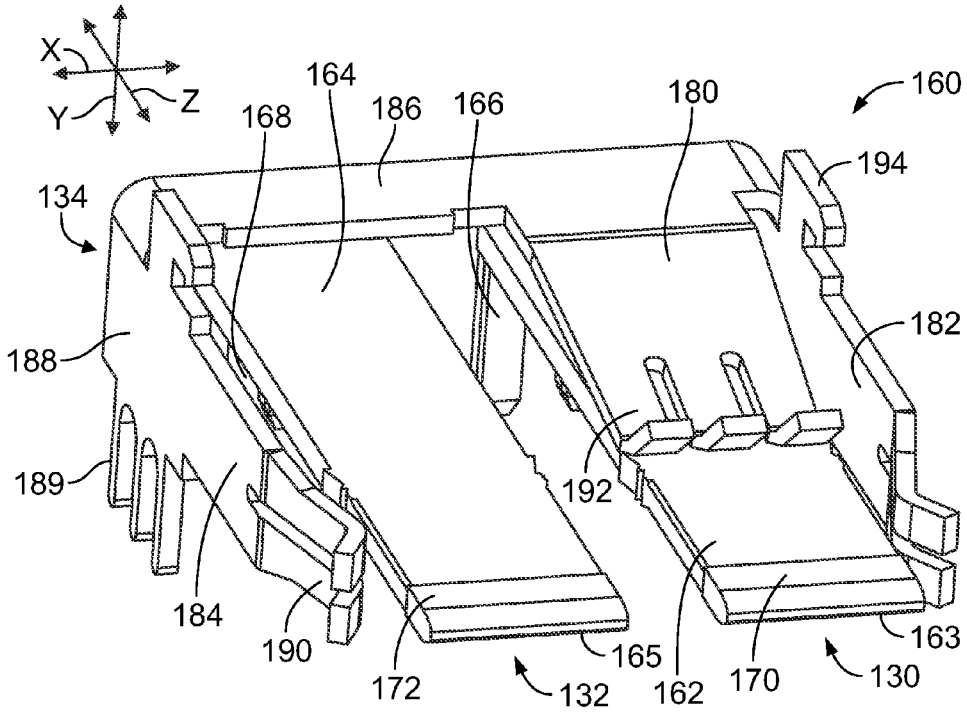
FIG. 3 is a front perspective view of the circuit assembly of FIG. 2.

FIGS. 2 and 3 are perspective views of a circuit assembly 160 that includes the first and second power contacts 130, 132 and the multi-function contact 134. In FIGS. 2 and 3, the first and second power contacts 130, 132 and the multi-function contact 134 are positioned relative to each other as these elements would be when the power connector 102 (FIG. 1) is fully constructed. In the illustrated embodiment, the first and second power contacts 130, 132 are identical such that the first and second power contacts 130, 132 are interchangeable. In other embodiments, however, the first and second power contacts 130, 132 may not be identical. For example, the first and second power contacts 130, 132 may be shaped and/or sized differently.

The first and second power contacts 130, 132 have body sections 162, 164, respectively, and contact tails or terminals 166, 168, respectively. The contact tails 166, 168 are configured to mechanically and electrically engage the electrical component 106 (FIG. 4). For example, the contact tails 166, 168 may be inserted into respective plated thru-holes (PTHs) (not shown) of the electrical component 106. The body sections 162, 164 extend parallel to each other and are coplanar in the illustrated embodiment. The body sections 162, 164 include distal ends 163, 165, respectively, that represent the portions of the first and second power contacts 130, 132, respectively, that initially engage the pluggable connector 104 (FIG. 1).

In the illustrated embodiment, the first and second power contacts 130, 132 include contact tips 170, 172, respectively. The contact tips 170, 172 comprise an effectively non-conductive material, such as plastic. In an exemplary embodiment, the distal ends 163, 165 are positioned proximate to the mating side 112 (FIG. 1). As used herein, the phrase "proximate to the mating side" includes the distal ends 163, 165 being located at the mating side 112 or being near the mating side 112, such as within the receiving cavity 124 (FIG. 1) or in an exterior of the power connector 102. In other embodiments, the distal ends 163, 165 may be located a substantial depth within the receiving cavity 124 or may clear and project away from the mating side 112 by a substantial distance.

In the illustrated embodiment, the multi-function contact 134 includes a switch segment 180 and first and second mating segments 182, 184. In other embodiments, the multi-function contact 134 may only include the switch segment 180 without the first and second mating segments 182, 184. In other embodiments, the multi-function contact 134 may only include the switch segment 180 and one of the mating segments 182, 184. The switch segment 180 and the first and second mating segments 182, 184 extend generally parallel to the Z-axis. The multi-function contact 134 also includes a bridge portion 186 that extends generally parallel to the X axis and joins the first and second mating segments 182, 184. The switch segment 180 extends away from the bridge portion 186. Accordingly, the switch segment 180 and the first and second mating segments 182, 184 are electrically common. In some embodiments, an entirety of the multi-function contact 134 is stamped-and-formed from a common piece of sheet metal.

The first and second mating segments 182, 184 are configured to engage the outer contacts 156 (FIG. 1), 158 (FIG. 6), respectively, when the pluggable connector 104 (FIG. 1) is inserted into the receiving cavity 124 (FIG. 1) of the power connector 102 (FIG. 1). In some embodiments, the first and second mating segments 182, 184 have similar shapes. The first and second mating segments 182, 184 oppose each other with the first and second power contacts 130, 132 positioned therebetween. As shown, the body sections 162, 164 of the first and second power contacts 130, 132, respectively, extend generally parallel to a XZ plane. The first and second mating segments 182, 184 extend generally parallel to a YZ plane. However, the body sections 162, 164 and/or the first and second mating segments 182, 184 may have other orientations. For example, in other embodiments, the body sections 162, 164 may extend generally parallel to the YZ plane.

Each of the first and second mating segments 182, 184 includes a base section 188 and contact tails or terminals 189 that project from the base section 188. The contact tails 189 are sized and shaped to engage the electrical component 106 (FIG. 4). For example, the contact tails 189 may be sized and shaped for insertion into PTHs (not shown). In the illustrated embodiment, the contact tails 166, 168, and 189 extend generally parallel to the Y axis. For embodiments in which the power connector 102 is a vertical connector, however, the contact tails 166, 168, and 189 may extend generally parallel to the Z axis.

Each of the first and second mating segments 182, 184 may also include one or more contact arms 190 that project from the corresponding base section 188 generally parallel to the Z axis. In the illustrated embodiment, the contact arms 190 of the first mating segment 182 are angled toward the first power contact 130, and the contact arms 190 of the second mating segment 184 are angled toward the second power contact 132. Also shown, the base section 188 for each of the first and second mating segments 182, 184 includes a coupling finger 194. The coupling fingers 194 are configured to engage the connector housing 110 (FIG. 1) to secure the multi-function contact 134 to the connector housing 110 and position the first and second mating segments 182, 184.

The switch segment 180 extends from the bridge portion 186 and generally toward the first power contact 130. The switch segment 180 also includes one or more contact arms 192. When the pluggable connector 104 (FIG. 1) and the power connector 102 (FIG. 1) are unmated, the contact arms 192 may be angled toward the first power contact 130 and engage the first power contact 130. In such embodiments, the multi-function contact 134 may be electrically coupled to the first power contact 130 through the switch segment 180. During a mating operation, the pluggable connector 104 (FIG. 1) may engage and deflect the switch segment 180 away from the first power contact 130 thereby de-coupling the switch segment 180 from the first power contact 130.

In other embodiments, however, the switch segment 180 may be shaped such that the contact arms 192 and the first power contact 130 have a gap therebetween when the switch segment 180 is in a non-deflected position. Accordingly, the multi-function contact 134 may not be electrically coupled to the first power contact 130 when the switch segment 180 is in the non-deflected position. In such embodiments, the pluggable connector 104 (FIG. 1) may engage the switch segment 180 during a mating operation to press the switch segment 180 against the first power contact 130, thereby electrically coupling the multi-function contact 134 and the first power contact 130.

FIG. 4 is a side view of a circuit board assembly 200 that includes the electrical component 106 and the power connector 102 mounted to the electrical component 106. In an exemplary embodiment, the electrical component 106 is a printed circuit board having, for example, traces, PTHs, vias, and ground planes (not shown). When the power connector 102 is mounted to the electrical component 106, the contact tails 166 (FIG. 2) of the first power contact 130 (FIG. 1), the contact tails 168 of the second power contact 132, the contact tails 189 of the first mating segment 182 (FIG. 2), and the contact tails 189 of the second mating segment 184 are terminated to the electrical component 106.

The connector housing 110 has a length 210 that extends from the mating side 112 to the back wall 117. As shown in FIG. 4, the mating side 112 of the connector housing 110 includes a cavity opening 204 that is sized and shaped to receive the pluggable connector 104 (FIG. 1). The cavity opening 204 may be defined by a plurality of edges. For example, the cavity opening 204 is defined by a wall edge 205 of the sidewall 119, a wall edge 206 of the top wall 116, a wall edge 207 of a contact panel 209 positioned along the mounting side 114, and a wall edge 208 (FIG. 5) of the sidewall 118 (FIG. 1). The distal end 165 of the second power contact 132 is positioned proximate to the mating side 112 such that the distal end 165 clears the wall edges 205, 208, but does not clear the wall edges 206, 207.

In some embodiments, one or more of the sidewalls 118 (FIG. 1), 119 has an inner edge 220 that defines a segment-receiving opening 222. The inner edge 220 may border an edge 135 of the multi-function contact 134. In FIG. 4, the segment-receiving opening 222 is sized and shaped to receive at least a majority of the mating segment 184. For example, the base section 188 of the mating segment 184 is positioned within the segment-receiving opening 222 and at least a portion of the contact arms 190 are positioned within the segment-receiving opening 222. Although the segment-receiving opening 222 has been described with reference to the sidewall 119, the sidewall 118 also includes a segment-receiving opening 224 as shown in FIG. 1, which may be similar to the segment-receiving opening 222.

Figure 5:
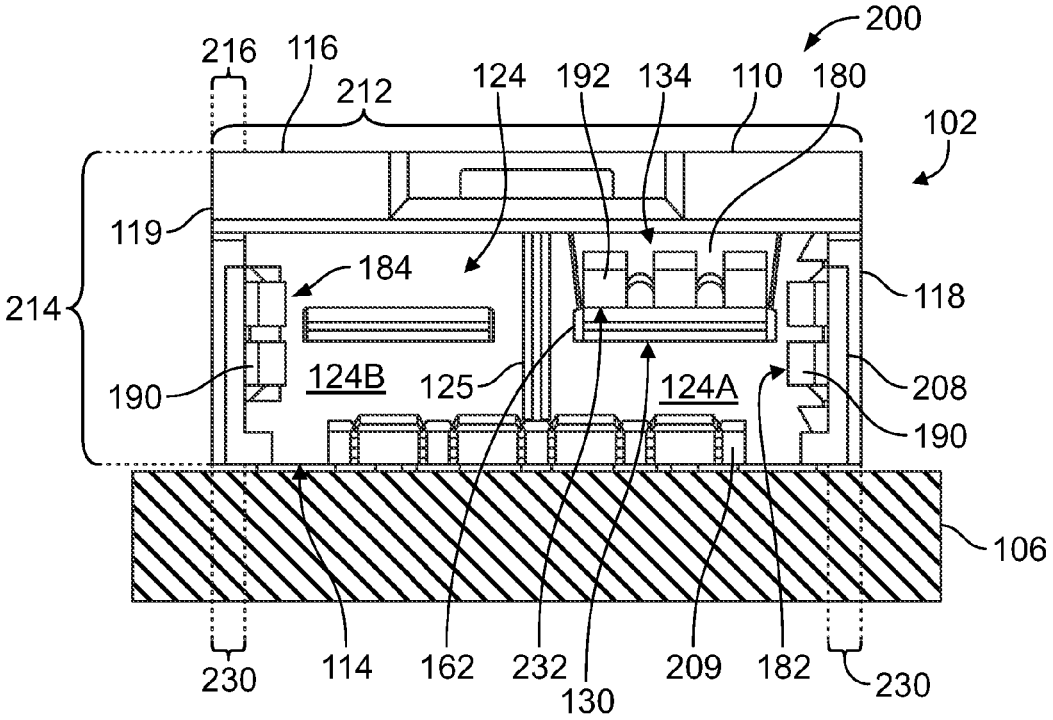
FIG. 5 is a front view of the circuit board assembly of FIG. 4 showing a receiving cavity of the power connector of FIG. 1.

FIG. 5 is a front view of the circuit board assembly 200. The power connector 102 has a width 212 that is measured between the sidewalls 118, 119, and a height or elevation 214 that is measured between the top wall 116 and the mounting side 114. The mounting side 114 may include the contact panel 209 and surfaces or edges of the sidewalls 118, 119. Each of the sidewalls 118, 119 interfaces with the electrical component 106 and has a thickness 216. In the illustrated embodiment, the thicknesses 216 of the sidewalls 118, 119 are essentially equal. In other embodiments, however, the thicknesses 216 may be unequal.

In some embodiments, the power connector 102 may be configured such that the multi-function contact 134 does not affect the footprint of the power connector 102. For example, each of the sidewalls 118, 119 is positioned within a three-dimensional (3D) space that is defined by the thickness 216, the height 214, and the length 210 (FIG. 4). In an exemplary embodiment, each of the mating segments 182, 184 is positioned within the segment-receiving openings 222 (FIG. 4), 224 (FIG. 1), respectively. Accordingly, the mating segments 182, 184 may be positioned within the respective 3D spaces of the sidewalls 118, 119. In such embodiments, it may not be necessary to increase the size of the connector housing 110 to accommodate the multi-function contact 134 (or the mating segments 182, 184).

In some embodiments, each of the sidewalls 118, 119 interfaces with the electrical component 106 along a mounting area 230 that is defined by the thickness 216 and the length 210 (FIG. 4). The contact terminals 189 (FIG. 2) of the mating segments 182, 184 of the multi-function contact 134 may be terminated to the electrical component 106 within the mounting area 230. In other embodiments, the contact terminals 189 of the mating segments 182, 184 of the multi-function contact 134 may be terminated to the electrical component 106 in an area below the receiving cavity 124.

Accordingly, the power connector 102 may replace a power connector (not shown) that is similar in size and shape to the power connector 102. For example, the circuit board assembly 200 may replace a legacy circuit board assembly (not shown) in which the form factor of the power connector 102 and the power connector of the legacy circuit board assembly may be essentially the same.

Also shown in FIG. 5, the respective contact arms 190 of the mating segments 182, 184 are shaped to extend into the receiving cavity 124 or, more specifically, into the cavity portions 124A, 124B, respectively. In FIG. 5, the contact arms 190 are shown in unengaged (or non-deflected) positions. The contact arms 190 are shaped such that the pluggable connector 104 (FIG. 1) engages and deflects the contacts arms 190 away from the receiving cavity 124 during the mating operation. In some embodiments, the respective contact arms 190 of the mating segments 182, 184 may be positioned within the segment-receiving openings 222, 224, respectively, after the contact arms 190 have been deflected by the pluggable connector 104.

Also shown in FIG. 5, the switch segment 180 has a mating interface 232 that directly engages the first power contact 130. In the illustrated embodiment, the mating interface 232 includes surfaces of the contact arms 192. In particular embodiments, the mating interface 232 engages the body section 162 of the first power contact 130. When the switch segment 180 is engaged to the first power contact 130, the switch segment 180 may be in a partially deflected state or position such that the switch segment 180 provides a normal force against the first power contact 130.

FIG. 6 is a perspective view of a circuit assembly 240 of the pluggable connector 104 (FIG. 1) in accordance with an embodiment. The circuit assembly 240 includes conductive elements that are used to transmit current through the pluggable connector 104. As shown, the circuit assembly 240 includes a first contact sub-assembly 242, a second contact sub-assembly 244, and a third contact sub-assembly 246. In some embodiments, the first contact sub-assembly 242 is configured to electrically couple to the first power contact 130 (FIG. 1) of the power connector 102 (FIG. 1), the second contact sub-assembly 244 is configured to electrically couple to the second power contact 132 (FIG. 1) of the power connector 102, and the third contact sub-assembly 246 is configured to electrical couple to the multi-function contact 134 (FIG. 2) of the power connector 102. As described herein, the circuit assembly 240 may enable certain AC applications.

The first contact sub-assembly 242 includes the first power contact 150, and the second contact sub-assembly 244 includes the second power contact 152. Each of the first and second power contacts 150, 152 includes a crimp portion 252 and opposing mating segments 254, 256. The crimp portions 252 are configured to surround wires of a corresponding cable and be deformed to engage and grip the wires of the cable. For example, the crimp portion 252 of the first power contact 150 may grip the wires (not shown) of the cable 123 (FIG. 1). As such, the wires of the cable 123 may be mechanically and electrically coupled to the first power contact 150.

The opposing mating segments 254, 256 are configured to engage a corresponding power contact of the power connector 102 (FIG. 1) therebetween. Each of the mating segments 254, 256 includes multiple contact arms 258. Optionally, each of the first and second contact sub-assemblies 242, 244 includes a grip element 260. The grip element 260 is configured to engage each of the mating segments 254, 256 and bias the mating segments 254, 256 or, more specifically, the contact arms 258 of the mating segments 254, 256 toward each other.

The third contact sub-assembly 246 includes a third power contact 250. The third power contact 250 may be similar to the first and second power contacts 150, 152 and include a crimp portion 252 and opposing mating segments 254, 256. In the illustrated embodiment, the power contacts 150, 152, 250 of the first, second, and third contact sub-assemblies 242, 244, 246, respectively, are identical. However, in other embodiments, the power contacts 150, 152, 250 may not be identical.

Unlike the first and second contact sub-assemblies 242, 244, the third contact sub-assembly 246 includes a conductor extension 270 that is mechanically and electrically coupled to the power contact 250 of the third contact sub-assembly 246. The conductor extension 270 may be stamped-and-formed from a common piece of sheet metal. In the illustrated embodiment, the conductor extension 270 includes a panel section 272 that is gripped by the mating segments 254, 256 of the third power contact 250, a junction section 274 that is coupled to the panel section 272, and first and second conductors 276, 278 that are coupled to the junction section 274. The first conductor 276 includes the outer contact 156, and the second conductor 278 includes the outer contact 158. Accordingly, the outer contacts 156, 158 are electrically commoned through the junction section 274.

The outer contacts 156, 158 include contact surfaces 157, 159 that face away from each other. The contact surfaces 157, 159 are configured to be exposed to an exterior of the plug housing 142 (FIG. 1) and engage the first and second mating segments 182, 184 (FIG. 2) of the multi-function contact 134 (FIG. 1). In the illustrated embodiment, the mating segments 254, 256 of the first and second power contacts 150, 152 are positioned between the outer contacts 156, 158. In the illustrated embodiment, each of the outer contacts 156, 158 includes a leading edge 279 that is positioned in front of the mating segments 254, 256 of the first and second power contacts 150, 152. The outer contacts 156, 158 may electrically couple to the mating segments 182, 184 (FIG. 2), respectively, of the power connector 102 (FIG. 1) before the first and second power contacts 150, 152 electrically couple to the first and second power contacts 130, 132 (FIG. 1), respectively, of the power connector 102.

Figure 7:
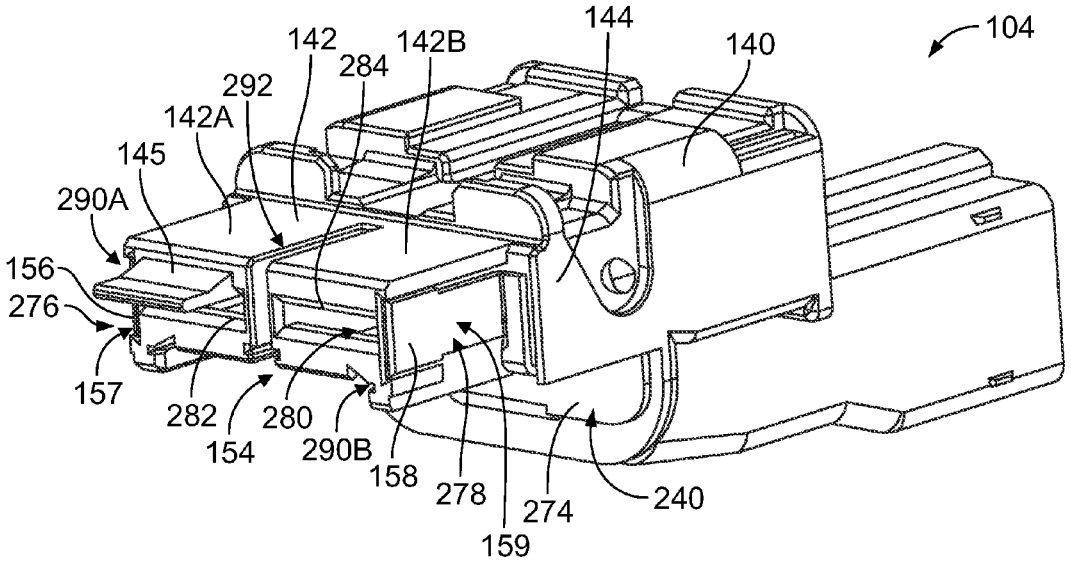
FIG. 7 is an isolated perspective view of the pluggable connector of FIG. 1.

FIG. 7 is an isolated perspective view of the pluggable connector 104. The connector body 140 is configured to support the circuit assembly 240. In the illustrated embodiment, the connector body 140 surrounds a majority of the circuit assembly 240 such that only the junction section 274 and the first and second conductors 276, 278 are exposed to an exterior of the connector body 140. However, the pluggable connector 104 may not be limited to the illustrated embodiment. For example, in other embodiments, the junction section 274 may be housed within the connector body 140.

The housing portions 142A, 142B are separated by a gap 292. The gap 292 is sized and shaped to receive the partition wall 125 (FIG. 1) during the mating operation. In the illustrated embodiment, the housing portions 142A, 142B form outer slots 290A, 290B, respectively, that are configured to receive the outer contact 156, 158, respectively. The outer contacts 156, 158 extend from the main housing 144. Accordingly, the contact surfaces 157, 159 are exposed at least partially along the plug housing 142 and positioned between the mating end 154 and the main housing 144.

The plug housing 142 forms a housing cavity 280. In the illustrated embodiment, the housing cavity 280 is accessed through first and second cavity slots 282, 284. More specifically, the housing portion 142A includes the first cavity slot 282, and the housing portion 142B includes the second cavity slot 284. The first cavity slot 282 is sized and shaped to receive the first power contact 130 (FIG. 1), and the second cavity slot 284 is sized and shaped to receive the second power contact 132 (FIG. 1). In the illustrated embodiment, the switch activator 145 is positioned immediately above the first cavity slot 282. In some embodiments, the switch activator 145 is configured to slidably engage the first power contact 130 during the mating operation.

Figure 8:
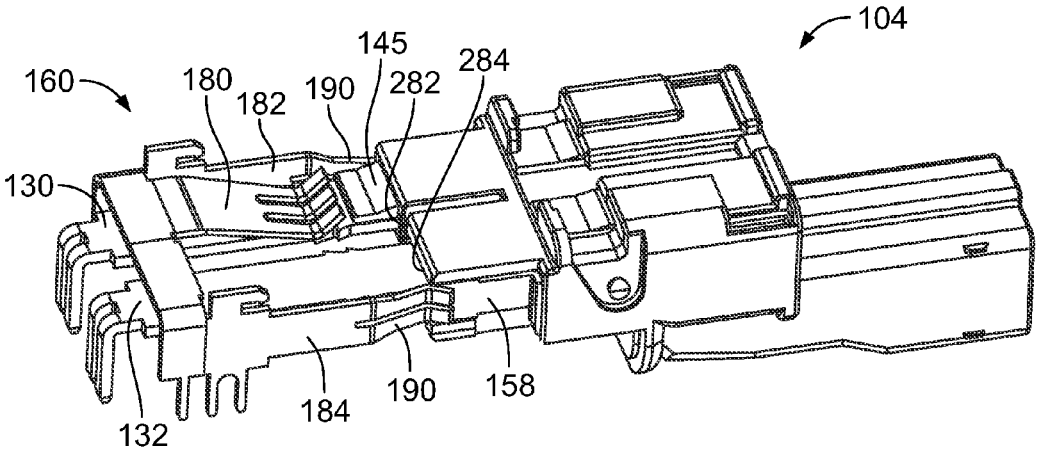
FIG. 8 illustrates the circuit assembly of the power connector of FIG. 1 at a first stage of a mating operation with the pluggable connector of FIG. 1.

FIG. 8 illustrates the circuit assembly 160 of the power connector 102 (FIG. 1) and the pluggable connector 104 at a first stage of the mating operation. The connector housing 110 (FIG. 1) has been removed for illustrative purposes. At the first stage, the outer contact 156 (FIG. 1) and the outer contact 158 have engaged the contact arms 190 of the first and second mating segments 182, 184, respectively. The distal ends 163, 165 (FIG. 2) of the first and second power contacts 130, 132, respectively, have been received within the first and second cavity slots 282, 284, respectively. At the first stage, the switch activator 145 is slidably engaged to the first power contact 130, but has not engaged the switch segment 180.

Figure 9:
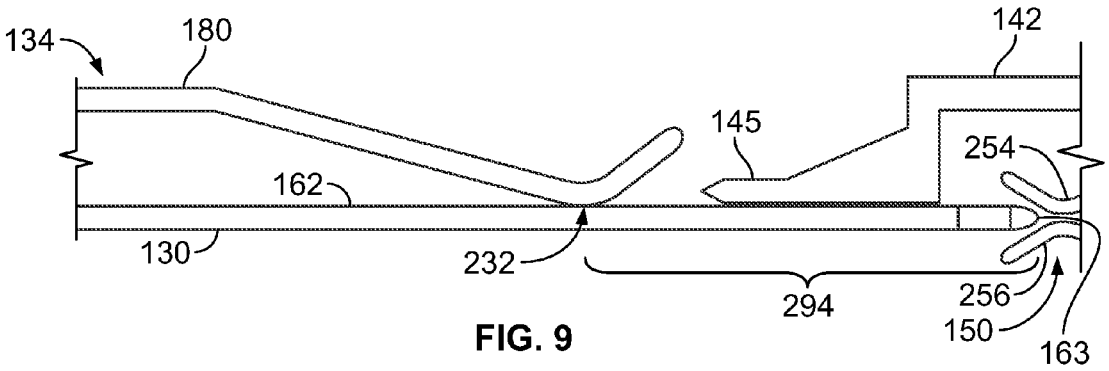
FIG. 9 is a side view of a power contact and a switch segment of a multi-function contact when the power connector and the pluggable connector of FIG. 1 are at the first stage of the mating operation.

FIG. 9 is a side view of the first power contact 130 and the switch segment 180 of the multi-function contact 134 at the first stage. A portion of the plug housing 142 is also shown. The switch segment 180 is in a first position relative to the first power contact 130 and the switch activator 145 of the plug housing 142. In the first position, the switch segment 180 may be in a partially deflected state such that the switch segment 180 provides a normal force against the first power contact 130 at the mating interface 232. The switch activator 145 is slidably engaged to the first power contact 130. The mating segments 254, 256 of the power contact 150, however, have not engaged the distal end 163 of the first power contact 130. The mating interface 232 is engaged to the body section 162 of the first power contact 130 at a designated location when the switch segment 180 is in the first position. As such, the switch segment 180 is electrically coupled to the first power contact 130. Also shown, the distal end 163 and the mating interface 232 define a terminating region 294 therebetween.

Figure 10:
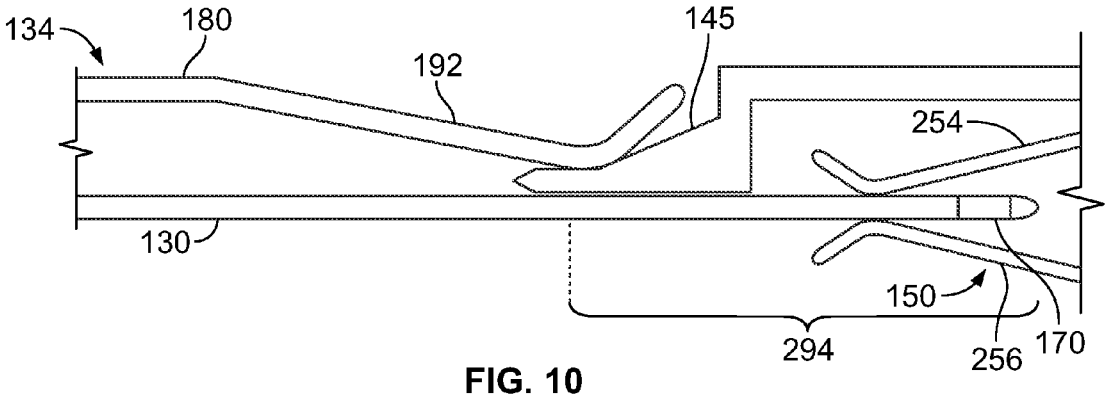
FIG. 10 is a side view of the power contact and the switch segment when the power connector and the pluggable connector of FIG. 1 are at a second stage of the mating operation.

FIG. 10 is a side view of the first power contact 130 and the switch segment 180 of the multi-function contact 134 at the second stage. At the second stage, the pluggable connector 104 (FIG. 1) may be fully mated with the power connector 102 (FIG. 1). In FIG. 10, the switch segment 180 is in the second position. During the mating operation, the switch activator 145 engages the contact arms 192 of the switch segment 180 and deflects the contact arms 192 away from the first power contact 130 thereby electrically separating the multi-function contact 134 and the first power contact 130. At approximately the same time that the switch segment 180 is engaged by the switch activator 145, the mating segments 254, 256 clear the contact tip 170 and electrically couple to the first power contact 130. For example, the switch segment 180 may be separated from the first power contact 130 and, subsequently, the mating segments 254, 256 may clear the contact tip 170 and electrically couple to the first power contact 130.

Accordingly, prior to the mating operation, the first power contact 130 may be grounded to earth through the multi-function contact 134. After the mating operation, the first power contact 130 may be electrically coupled to the power contact 150. To this end, the terminating region 294, the switch activator 145, and the mating segments 254, 256 are sized and positioned relative to one another such that the first power contact 130 is electrically decoupled from the multi-function contact 134 prior to or at about the same time that the first power contact 150 of the pluggable connector 104 (FIG. 1) is electrically coupled to the first power contact 130 of the power connector 102 (FIG. 1).

Although not shown in FIGS. 9 and 10, the mating segments 254, 256 of the power contact 152 (FIG. 6) may engage the second power contact 132 (FIG. 1) in a similar manner. Also not shown, the mating segments 182, 184 (FIG. 2) of the multi-function contact 134 may be engaged to the outer contacts 156, 158 (FIG. 6), respectively, after the mating operation. Accordingly, after the mating operation, the first power contact 130 of the power connector 102 (FIG. 1) is electrically coupled to the first power contact 150 of the pluggable connector 104 (FIG. 1), the second power contact 132 (FIG. 1) of the power connector 102 is electrically coupled to the second power contact 152 (FIG. 6) of the pluggable connector 104, and the third power contact 250 (FIG. 6) of the pluggable connector 104 is electrically coupled to the multi-function contact 134.

FIG. 11 illustrates a pluggable connector 300 that is also configured to mate with the power connector 102 (FIG. 1). Unlike the pluggable connector 104 (FIG. 1), the pluggable connector 300 may be a two-wire connector. For example, the pluggable connector 104 may include first and second power contacts (not shown) disposed within a housing cavity 302 of the pluggable connector 300. The pluggable connector 300 may be configured for DC applications. In some embodiments, each of the pluggable connector 104 and the pluggable connector 300 are configured to mate with the power connector 102 (FIG. 1) during separate mating operations. However, the pluggable connector 300 does not include a switch activator, such as the switch activator 145 (FIG. 1), and does not include outer contacts, such as the outer contacts 156 (FIG. 1), 158 (FIG. 6). After the pluggable connector 300 mates with the power connector 102, the switch segment 180 (FIG. 2) may remain engaged to the first power contact 130. Accordingly, in some embodiments, the board and/or chassis ground of the power connector 102 may be grounded to earth through the switch segment 180 of the multi-function contact 134.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A power connector configured to mate with different types of pluggable connectors, the power connector comprising:

a connector housing having a mating side and a mounting side, the connector housing including a receiving cavity that opens to the mating side, the mounting side configured to interface with an electrical component;

first and second power contacts disposed within the receiving cavity and configured to be terminated to the electrical component; and a multi-function contact configured to be terminated to the electrical component and having a switch segment disposed within the receiving cavity, the switch segment having a mating interface and being configured to flex between first and second positions, the mating interface of the switch segment engaging the first power contact in the first position and being separated from the first power contact in the second position.

2. The power connector of claim 1, wherein the power connector is configured to mate with a two-wire pluggable connector when the switch segment is engaged with the first power contact and a three-wire pluggable connector when the switch segment is deflected away from the first power contact.

3. The power connector of claim 1, wherein the switch segment is configured to be deflected from the first position to the second position during a mating operation between the power connector and one of the pluggable connectors.

4. The power connector of claim 1, wherein the multi-function contact includes a mating segment that is disposed within the receiving cavity, the mating segment configured to engage a corresponding contact of one of the pluggable connectors.

5. The power connector of claim 4, wherein the mating segment and the switch segment extend generally parallel to respective planes, the respective planes being orthogonal to each other.

6. The power connector of claim 4, wherein the mating segment is a first mating segment and the multi-function contact includes a second mating segment, the first and second power contacts being positioned generally between the first and second mating segments.

7. The power connector of claim 4, wherein the connector housing includes a sidewall that is configured to interface with the electrical component, the sidewall existing within a three-dimensional space, wherein at least a majority of the mating segment is positioned within the three-dimensional space when the mating segment is in an engaged position.

8. The power connector of claim 4, wherein the connector housing includes a sidewall that is configured to interface with the electrical component, wherein the sidewall has a segment-receiving opening, at least a portion of the mating segment being positioned within the segment-receiving opening.

9. The power connector of claim 1, wherein the first power contact has a distal end positioned proximate to the mating side and the mating interface engages the first power contact at a designated location, the mating interface and the distal end defining a terminating region therebetween, the terminating region being sized and shaped to engage a corresponding contact of one of the pluggable connectors when the power connector is mated with the corresponding pluggable connector.

10. The power connector of claim 1, wherein the first power contact, the second power contact, and the multi-function contact operate as separate electrical pathways when the switch segment is in the second position.

11. A pluggable connector comprising:

a connector body having a main housing and a plug housing that projects from the main housing, the plug housing configured to be inserted into a receiving cavity of a power connector during a mating operation, the plug housing having a mating end that leads the plug housing into the receiving cavity, the plug housing defining a housing cavity that opens to the mating end;

first and second power contacts disposed within the housing cavity and configured to engage corresponding contacts of the power connector during the mating operation; and an outer contact having a contact surface, at least a portion of the contact surface extending between the main housing and the mating end of the plug housing, the contact surface being exposed to an exterior of the plug housing and configured to engage a corresponding contact of the power connector during the mating operation, wherein the first power contact, the second power contact, and the outer contact operate as separate electrical pathways.

12. The pluggable connector of claim 11, wherein the pluggable connector is a three-wire connector configured for alternating current (AC) applications.

13. The pluggable connector of claim 11, wherein the outer contact is a first outer contact, the pluggable connector further comprising a second outer contact having a contact surface that is exposed to the exterior of the plug housing.

14. The pluggable connector of claim 13, wherein the first and second outer contacts are electrically common.

15. The pluggable connector of claim 13, wherein the contact surfaces of the first and second outer contacts face in opposite directions, the first and second power contacts being positioned between the first and second outer contacts.

16. The pluggable connector of claim 11, wherein the outer contact has a leading edge that is positioned in front of the first and second power contacts.

17. The pluggable connector of claim 11, wherein each of the first and second power contacts includes opposing mating segments that are configured to engage the corresponding contact therebetween.

18. The pluggable connector of claim 11, wherein the plug housing includes a front edge, the mating end having a switch activator that projects from the front edge and leads the plug housing into the receiving cavity of the power connector.

19. An interconnection system comprising:

a power connector configured to be mounted to an electrical component, the power connector including a connector housing having a mating side and a receiving cavity that opens to the mating side, the power connector including first and second power contacts disposed within the receiving cavity and a multi-function contact having a switch segment that is disposed within the receiving cavity, the switch segment being capable of flexing between first and second positions; and a pluggable connector including a plug housing configured to be inserted into the receiving cavity of the power connector, the plug housing having a mating end that includes a switch activator, the plug housing defining a housing cavity that opens to the mating end, the pluggable connector including first and second power contacts disposed within the housing cavity; and wherein the power connector and the pluggable connector are configured to mate with each other during a mating operation, the switch activator of the pluggable connector leading the plug housing into the receiving cavity during the mating operation and engaging the switch segment of the multi-function contact of the power connector, the switch activator deflecting the switch segment from the first position to the second position or from the second position to the first position, the first and second power contacts of the pluggable connector and the first and second power contacts of the power connector, respectively, being engaged after the mating operation.

20. The interconnection system of claim 19, wherein the multi-function contact includes a mating segment that is disposed within the receiving cavity of the power connector, the pluggable connector including an outer contact having a contact surface exposed to an exterior of the plug housing, wherein the outer contact and the mating segment of the multi-function contact are engaged after the mating operation.

* * * * *